United States Patent [19]

Brechlin et al.

[11] 4,157,974

[45] Jun. 12, 1979

[54] ELECTROPHOTOGRAPHIC LIQUID DEVELOPER AND PROCESS FOR THE MANUFACTURE THEREOF

[75] Inventors: Alfred Brechlin; Heinz Herrmann, both of Wiesbaden-Biebrich, Fed. Rep. of Germany

[73] Assignee: Hoechst Aktiengesellschaft, Fed. Rep. of Germany

[21] Appl. No.: 878,095

[22] Filed: Feb. 15, 1978

Related U.S. Application Data

[63] Continuation of Ser. No. 734,940, Oct. 22, 1976, abandoned, which is a continuation of Ser. No. 483,883, Jun. 27, 1974, abandoned.

[30] Foreign Application Priority Data

Jun. 29, 1973 [DE] Fed. Rep. of Germany ..... 2333064

[51] Int. Cl.[2] ..... G03G 9/12

[52] U.S. Cl. ..... 252/62.1 L; 260/42.14

[58] Field of Search ..... 252/62.1 L; 260/42.14

[56] References Cited

U.S. PATENT DOCUMENTS

| | | | |
|---|---|---|---|
| 2,891,911 | 6/1959 | Mayer et al. | 252/62.1 L |
| 2,899,335 | 8/1959 | Straughan | 252/62.1 L |
| 3,668,127 | 6/1972 | Machida et al. | 252/62.1 L |
| 3,839,032 | 10/1974 | Smith et al. | 252/62.1 L |

*Primary Examiner*—Roland E. Martin, Jr.
*Attorney, Agent, or Firm*—James E. Bryan

[57] ABSTRACT

This invention relates to a liquid developer for developing electrostatic images which comprises an electrically insulating carrier liquid having dispersed therein pigmented polymer particles composed of pigment particles encapsulated by polymeric material and having a particle size in the range of about 0.1 to 12 μm. The invention also includes a process for the preparation of the liquid developer.

10 Claims, No Drawings

ELECTROPHOTOGRAPHIC LIQUID DEVELOPER AND PROCESS FOR THE MANUFACTURE THEREOF

This is a continuation of application Ser. No. 734,940, filed Oct. 22, 1976, now abandoned, in turn a continuation of Ser. No. 483,883, filed June 27, 1974, now abandoned.

The present invention relates to an electrophotographic liquid developer and to a process for the manufacture thereof.

Electrophotographic copying processes are based on the fact that a latent electrostatic image which corresponds to an original is produced on a photoconductor layer. This charge image is then contacted with a developer and rendered visible through the triboelectrically charged, colored toner particles of the developer depositing, in accordance with their polarity, on the areas of opposite charge.

Several processes by means of which an electrostatic charge image may be rendered visible already have been described.

In one process, the photoconductor consists of zinc oxide which is applied as a coating, by means of a binder, on a two-dimensional carrier, for example paper or foil. In this case, the electrostatic charge image produced is treated with a liquid developer. Such a liquid developer consists of one or more finely divided pigments which are dispersed in a liquid of high electrical resistance. Additionally, resinous substances acting as binders are present in solution in the liquid; the function of these is to fix the pigment particles deposited on the electrostatic charge image, when drying the copy, i.e. to cement them to the photoconductor layer so as to obtain a non-smudging copy.

In another process, the so-called transfer process, the photoconductor consists of an inorganic or organic substance which also can be applied to a two-dimensional carrier. An electrostatic charge image which corresponds to an original, and which can be made visible, for example, by application of a pulverulent developer of toner and carrier, can be produced in a known manner on the photoconductor by charging, and exposing the original. The toner image can be transferred onto a smooth white paper in various ways and can be fixed by heat, pressure or solvent vapors.

If the photoconductor is not on a planar carrier, but on the curved surface of, for example, a drum, the sequence of charging the photoconductor, image-wise exposure, developing and transfer of the toner image onto paper can be repeated as often as desired, if care is taken that the residual image remaining on the photoconductor after the transfer is removed before starting a fresh copying cycle. Such pulverulent toners generally consist of powdered pigmented polymers which in most cases have been fused with resins and plasticizers. However, powder toners have the disadvantage, compared to liquid toners, that they cause dust and can produce objectionable deposits in the copying apparatus. In addition, they must be used conjointly with a carrier material, which as a rule has been pretreated, in order to accept the triboelectric charge which is required to produce the image and which can be of the same polarity as the polarity of the charge image, or opposite thereto. In addition, powder toners must be fixed to the paper in order to give non-smudging copies and this is in general achieved by fusing. For apparatus with a high output of copies, the fusing requires a considerable expenditure of energy. Attempts therefore have been made to develop the electrostatic charge image present on the photoconductor surface of a drum by means of liquid toners such as were known for zinc oxide paper and to transfer the developed image, after removal of the excess developer liquid, onto normal paper. However, it has been found that these images developed with liquid pigment dispersions can be transferred only very imperfectly onto paper.

Various proposals for improving the transfer to the liquid-developed image from the photoconductor drum onto the paper have been made in German Offenlegungsschriften Nos. 2,110,409; 2,144,066; and 2,147,646, where very special papers containing polymer and having a low oil absorbency must be used.

According to another proposal (German Offenlegungsschrift No. 2,127,838), the toner image present on the photoconductor, which has not yet been freed from excess developer, is transferred onto paper which has first been moistened with a low-boiling solvent, which reduces or prevents the absorption of developer liquid.

German Offenlegungsschrift No. 2,229,044 discloses a process which uses modified liquid developers which consist of dyed or pigmented polymer particles dispersed in a carrier liquid of high electrical resistance, with the polymer particles containing solvents of high solvent power. As a result of this, and of the choice of special polymers, the dispersed organosol particles have a certain tackiness, the effect of which is that the adhesion of the particles, deposited under the influence of the electrostatic image forces, to the photoconductor surface is only slight and that, on the other hand, the adhesion to normal smooth paper which is brought into intimate contact with the toner image is so great that a transfer of the toner image from the photoconductor onto the paper is possible merely by virtue of the tackiness and without the use of an electrical field. After penetration of the solvent constituents of the swollen organosol particles into the paper intended to receive the image, the copy is fixed and is no longer tacky.

The previously proposed processes of transferring liquid-developed toner images from the photoconductor layer onto paper (however) show the following disadvantages: the use of specially pretreated paper is uneconomical because of the cost associated with its manufacture, and reduces the possible applications of the process; a pre-wetting of the copying paper with readily volatile solvents reduces the copying speed and increases the evolution of harmful solvent vapors into the surrounding atmosphere. If dispersed organosols are used as developers, the transfer from the photoconductor to paper, especially at higher copying speeds, is not entirely adequate since in the short contact times available the forces of adhesion to the photoconductor cannot be overcome entirely and thus the toner is not removed completely from the photoconductor. As a consequence, it proves difficult to clean the photoconductor drum before the next copying cycle. In addition the stability of the organosols used is not always satisfactory, because of the high solvent power of the solvents which have to be used, which results in a certain surface tackiness already being imparted to the polymer particles in dispersion, leading to a coarsening of the particles by coalescence. However, it has been found specifically that toners which are as finely divided as possible are necessary to achieve good resolution of the image coupled with good stability.

Admittedly it is possible, according to a proposal of German Offenlegungsschrift No. 2,262,603, to arrive at an improved version of the organosol toner by addition of small amounts of water and as a result to transfer the toner image more easily from the photoconductor surface onto the paper; toners of this type, however, have, as a result of their method of manufacture, a relatively high content, generally of at least 100 percent by weight relative to the total solids content, of aromatic solvents and other solvents of high solvent power (expressed by a Kauri butanol number, according to ASTM 1133, of more than 50). In continued use, the solvents, because of their high solvent power, tend to attack the rubber rollers, guide devices and seals present in the copying apparatus.

There is therefore a need for an electrophotographic liquid developer for the transfer process which can be manufactured as simply as possible; which is sufficiently tacky while containing a minimal amount of solvent, if any; which permits transference of the deposited toner image practically completely, even at high copying speeds, from the photoconductor surface onto normal paper; and which, while having as small a particle size as possible, exhibits improved stability. The present invention accordingly provides a liquid developer for developing electrostatic images which comprises an electrically insulating carrier liquid having dispersed therein pigmented polymer particles composed of pigment particles encapsulated by polymeric material and having a particle size in the range of 0.1 to 12 μm.

The particles preferably have a particle size in the range of 1 to 5 μm.

The term "particle size" is used herein to mean the average particle diameter, and may be measured by means of a particle size counter, for example, the Micro-Videomat of Messrs. Carl Zeiss, Oberkochen, Germany.

The developer according to the invention generally will contain the conventional additives used in liquid developers of this type, i.e. protective colloids, control agents, and, optionally, dispersing auxiliaries.

The liquid developer according to the invention contains finely divided stable particles; the small size of the particles permits improved resolution of the image and gives improved stability to sedimentation. As no solvents of high solvent power are present, the pigment particles encapsulated by the polymer layer do not possess any pronounced mutual tackiness in dispersion, and do not therefore coarsen due to coalescence.

The polymers used are preferably at least partially soluble in the electrically insulating organic carrier liquid when warm; however, at room temperature they have as low a solubility in the liquid as possible. Preferably, polymers, mixed polymers or copolymers are employed which are swelled to a certain extent by the liquid at room temperature, on which effect their tackiness towards the receiving material is based. For example, copolymers of vinyltoluene or of styrene with esters of acrylic or methacrylic acid, for example, vinyltoluene/octyl acrylate copolymers and styrene/n-butyl methacrylate copolymers, have proved suitable; vinyltoluene-acrylic resins which are known, for example, by the name Pliolite® a vinyl-tolueneacrylate copolymer of Goodyear Tire and Rubber Co., USA, are particularly suitable.

The pigment used suitably may be finely divided carbon black, but any pigments or pigment mixture may be employed. In addition to the pigment, dyestuffs also can be employed, to produce a more attractive color shade and to influence the triboelectric chargeability. Dyestuffs such as Reflex Blue B (Colour Index (C.I.) 42,765), Spirit-soluble Nigrosin (C.I. 50,420) or Fat Black HB or HBN (C.I. 26,150) have proved particularly suitable for this purpose.

Suitable protective colloids which prevent the agglomeration of the pigmented polymer in the insulating liquid are copolymers of butadiene and of styrene, for example, those known under the name Solprene® a styrene/butadiene copolymer of Phillips Petroleum Co., USA. In particular, a copolymer which is composed of 75 percent by weight of butadiene and 25 percent by weight of styrene, such as Solprene 1205, a copolymer of about 75 weight percent butadiene and 25 weight percent styrene (a product of Phillips Petroleum Co., New York) has proved suitable. Further substances which may be used as protective colloids include esters of polyvinyl alcohol, for example, polyvinyl stearates; esters of colophony, for example, those marketed under the name Pentalyn® a pentaerythritol ester of rosin and modified rosin of Hercules Powder Company, USA; and aliphatic hydrocarbon resins, for example, the grades 1102 B or 5000 known under the name Escorez® a copolymer of α-methylstyrene and vinyl toluene of Esso Chemicals. The added protective colloid also may serve as a dispersing auxiliary.

Other compounds which may be used as dispersing auxiliaries include fatty alcohol polyglycol ethers, for example those under the name of Genapol® S-020 a fatty alcohol polyglycol ether or Emulsogen® M, a fatty acid polyglycol ester or fatty acid polyglycol esters, for example, Emulsogen SG (all manufactured by Farbwerke Hoechst AG, Germany).

As control auxiliaries for influencing the triboelectric chargeability, it is possible to employ for example, color pastes such as Reflex Blue AMF (C.I. 42,770:1) or Reflex Blue A6H-G, or salts of fatty acids having 16–18 carbon atoms with dyestuff bases, for examples:

| | | |
|---|---|---|
| Indulin Base N | (C.I. Solvent Blue 7) | 50,400 B |
| Methyl Violet Base | (C.I. Solvent Violet 8) | 42,535 B |
| Crystal Violet Base | (C.I. Solvent Violet 9) | 42.555 B |
| Victoria Blue Base F4R | (C.I. Solvent Blue 2) | 42,563 B |
| Victoria Blue Base FB | (C.I. Solvent Blue 4) | 44,045 B |
| Victoria Blue Base B | (C.I. Solvent Blue 4) | 44,045 B |
| Victoria Pure Blue Base FGA | (C.I. Solvent Blue 81) | |
| Blue Base KG | (C.I. Solvent Blue 64) | |
| Nigrosin Base LTK | (C.I. Solvent Black 7) | 50,415 B |
| Indulin Base NF | (C.I. Solvent Blue 7) | 50,400 B |
| Indulin Base NR | | |
| Nigrosin Base C | (C.I. Solvent Black 7) | 50,415 B |

The salts may be prepared by reaction of the fatty acid with the dyestuff base and subsequent grinding on a roll mill.

The ratio in which the individual solid components of the electrophotographic liquid developer according to the invention may be mixed can vary within wide limits. However, it has been found that it is particularly advantageous to use: 4–100 parts by weight, preferably 4–50 parts by weight, of polymer per part by weight of pigment; this proportion of polymer also may include the protective colloid. The ratio of pigment to control auxiliaries is preferably 1 part by weight to 0.002 to 1, preferably to 0.02 to 0.6, part by weight.

The polymer which acts as the protective colloid is advantageously used in about the same amount as the polymer which encapsulates the pigment; it is preferably present in an amount of from 0.1 to 2 parts by weight per part by weight of polymer.

The ratio of protective colloid polymer to dispersing auxiliaries is preferably 1 part by weight per 0.01 to 1 part by weight.

A suitable carrier liquid is an organic liquid which has a high electrical resistance and a low dielectric constant. Such liquids in particular include aliphatic hydrocarbons boiling between 120° and 200° C. A hydrocarbon or mixture of hydrocarbons which has a boiling point or range of 150° and 190° C., for example, those known by the names of Isopar® G or H synthetic hydrocarbons of different boiling ranges of Esso, is particularly suitable.

The liquid developers according to the invention are generally dispersions having a solids content in the range of from 0.5 to 5 percent by weight.

If desired, the liquid developer according to the invention may contain small amounts of solvent for the dispersed polymer. In this way, the ability of the polymer to swell in the electrically insulating liquid at room temperature, and thus the tackiness of the particles, may be adjusted at will. Such a solvent must be compatible with the other additives present, for example, the protective colloid. It is possible to use solvents which have been employed for this purpose in the previously proposed processes, for example, aromatic hydrocarbons, halogenated hydrocarbons or esters and ketones; aromatic hydrocarbons boiling in the range of 160° to 180° C., for example, those known under the name Solvesso° a hydrogenated petroleum distillation product resembling gasoline of Esso, especially Solvesso 100, have proved particularly suitable. The solvents may be used in very much smaller quantities than those employed in the previously proposed processes; the range of amount of solvent added is generally up to 0.3 part by weight per 1 part by weight of total solids. As a result of the addition, the adhesion of the toner to the photoconductor or to the receiving paper can be varied within wide limits and the tackiness can be adapted to the desired purpose, and the addition even can be made at any desired point in time, as a result of which the stability of the liquid developer according to the invention is very considerably improved.

The present invention also provides a process for the preparation of a liquid developer according to the invention, which comprises dispersing a homogeneous particulate mixture of at least one polymer and at least one pigment, which may contain conventional additives, in an electrically insulating carrier liquid, at a temperature within the softening range of the polymer, with grinding, and grinding the dispersion obtained as it cools to room temperature. Generally, the solid is dispersed in a small quantity of carrier liquid, and the mixture obtained is ground as additional carrier liquid is added and the dispersion cools to room temperature. The dispersion is preferably effected at a temperature in the range of 50° to 150° C. A temperature range of 70° to 90° C. has proved particularly suitable.

The homogeneous particulate mixture of polymer and pigment is preferably prepared by homogeneously mixing the polymer and the pigment at a temperature above the softening point of the polymer, preferably within the range of 100° to 200° C.; the homogenizing may be effected, for example, in a two-roll mill, an extruder or a kneader. The homogenized mass then may be cooled and comminuted, preferably to a particle size of 30 μm or less. This method of mixing means that each pigment particle is, in a sense, already surrounded with the polymer layers necessary for its requisite triboelectric properties before being dispersed in the electrically insulating carrier liquid. With this procedure, the partial solubility of the polymer in the warm electrically insulating carrier liquid is utilized to reach an organosol-like state, but without using solvents of high solvent power.

Upon cooling, the polymer constituents which become insoluble at room temperature separate out and become disturbed particularly finely in the carrier liquid under the influence of the grinding forces, thus giving a stable dispersion of pigmented polymer particles.

As a rule, carbon black is used as the pigment component, but any pigments or pigment mixture may be used. In addition to the pigment, it is also possible to incorporate dyestuffs or further additives, such as protective colloids, control agents and dispersing auxiliaries, which give the polymer the desired electrostatic properties, into the warm pigment/polymer mixture. Preferably, dyestuffs such as Reflex Blue B—Colour Index 42,765, Spirit-soluble Nigrosin—C.I. 50,420, or Fat Black HB or HBN—C.I. 26,150, are added to the pigment.

The polymers used are preferably at least partially soluble in the carrier liquid used when warm, but have as low a solubility as possible in this liquid when cold. Preferably, polymers or copolymers are employed which undergo a certain swelling effect by the liquid at room temperature, on which effect their tackiness is based. Suitable polymers include copolymers of vinyltoluene or of styrene with acrylic acid esters. Vinyltoluene-acrylate resins such as are known under the name Pliolite® VTAC or VTAC-L copolymers of vinyl toluene and ethyl hexyl acrylate of Goodyear Tire and Rubber Company, USA, are particularly suitable.

Further unpigmented polymers, copolymers or resins, which may or may not be soluble in the carrier liquid, may be added to facilitate the subsequent dispersing in the electrically insulating organic carrier liquid; these further additives may include copolymers of styrene and of butadiene, esters of polyvinyl alcohol, colophony esters or aliphatic hydrocarbon resins.

The pigmented polymer is dispersed in the liquid at a temperature in the softening range of the polymer. It has been found that the substance which acts as the protective colloid and/or, if relevant, the dispersing auxiliary and the control agent, also may be added to the carrier liquid. Such an addition is not made, however, if such additives have been incorporated into the pigmented polymer. It is preferred that the protective colloid and, if relevant, the dispersing auxiliary, are added to the liquid.

When using pre-dispersed commercially available grades of pigment, it has been found that the substances used for the predispersing, the nature of which is generally not known, exert an adverse influence on the triboelectric properties of the pigmented polymer particles. For this reason, non-predispersed pigment grades are employed preferentially according to the invention.

A preferred procedure according to the invention is now described by way of example only. To disperse the dyed or pigmented polymers, the substances which act as a protective colloid or dispersing auxiliary are first dissolved in a part of the carrier liquid. The finely powdered, pigmented mass is then introduced into the carrier liquid in an efficient dispersing apparatus such as a dissolver, disperser or a "pearl mill" at elevated temperatures, suitably in the range of about 50° to 150° C., and, if appropriate, further pigments, dyestuffs or control auxiliaries to influence the triboelectric chargeability of the particles are added.

After the solution equilibrium between the components has become established, the mixture is allowed to cool gradually to room temperature while being ground and the remaining amount of the carrier liquid is then added in small portions, while stirring. During this step, the polymer constituents which dissolved in the warm mixture but are sparingly soluble at room temperature separate out in a finely divided form in accordance with their solubility in the carrier liquid, which liquid should have only a low solvent power for these polymers. This gives spherical non-cohering particles of about less than 12 μm, preferably less than 5 μm, in diameter, which are outstandingly suitable for use as a toner. Because no solvents of high solvent power are present, these particles remain separate even in storage.

The electrically insulating carrier liquid is preferably an organic liquid of high electrical resistance and low dielectric constant, in particular, an aliphatic hydrocarbon or mixture of aliphatic hydrocarbons boiling in the range of 120° to 200° C. Hydrocarbons or mixtures thereof which have a boiling point in the range of 150° to 180° C., for example, Isopar® G and H of Esso, may be advantageously used.

Depending upon the end use, toner concentrates of different solids contents may be prepared; for example a concentrate may contain 3–12 parts by weight of carrier liquid per 1 part by weight of total solids. Such a concentrate can be diluted as desired, by the addition of carrier liquid, to give a developer of the desired concentration for any particular use.

The process according to the invention permits the tackiness of the finished liquid developer, and hence the adhesion to the photoconductor or to the transfer material to be adjusted at will by the addition of small or very small amounts of solvent. It has been found that additions of at most 0.3 part by weight of solvent per 1 part by weight of total solids are entirely sufficient for adhesion and below this weight ratio the adhesion can be varied within wide limits and adapted to the desired end use. Possible solvents are aromatic hydrocarbons, halogenated hydrocarbons, esters and ketones. Aromatic hydrocarbons, especially those boiling within the range of 160° to 180° C., for example Solvesso® 100 of Esso, are particularly suitable.

Liquid developers or liquid developer concentrates prepared according to the process of the invention retain their finely divided state even over a prolonged period of time and thus have a very long shelf life; a concentrate may be converted into a finished liquid developer at any desired time by addition of carrier liquid, and can, in addition, be adjusted to the desired degree of tackiness.

The following examples further illustrate the invention.

I Preparation of the Pigmented Polymer

EXAMPLE Ia

To manufacture the pigmented polymer, 3.5 parts by weight of carbon black of average particle size 27 nm are mixed with 96.5 parts by weight of a vinyltoluene/octyl acrylate copolymer, Pliolite® VTAC (Goodyear), comminuted to approximately 1 mm particle size. This mixture is homogenized at approximately 160° C. in a screw mixer. After cooling, the mass is crushed, and ground in a mill, and the constituents of less than 30 μm are separated off and used for the manufacture of the developer solid.

EXAMPLE Ib

To manufacture a pigmented polymer which at the same time contains a control agent, the procedure of Example Ia is followed and the following are homogenized at a temperature of approximately 150° C.:

- 3.2 parts by weight of carbon black,
- 94.7 parts by weight of vinyltoluene/octyl acrylate copolymer, and
- 2.1 parts by weight of Reflex Blue B (C.I. 42,765).

EXAMPLE Ic

The following pigmented polymer is manufactured in accordance with the process of Example Ib:

- 3.2 parts by weight of carbon black,
- 95.8 parts by weight of vinyltoluene/octyl acrylate copolymer, and
- 1.0 part by weight of Spirit-soluble Nigrosin (C.I. 50,420).

EXAMPLE Id

To manufacture a pigmented polymer which at the same time contains a soluble polymer acting as the protective colloid, and a control agent, the procedure in Example Ia is followed and the following are homogenized at a temperature of approximately 140° C.:

- 2.0 parts by weight of carbon black,
- 57.9 parts by weight of vinyltoluene/octyl acrylate copolymer
- 38.9 parts by weight of styrene/butadiene copolymer Solprene® 1205 of Phillips Petroleum Co., and
- 1.25 parts by weight of Reflex Blue B.

EXAMPLE Ie

To manufacture a pigmented polymer which at the same time contains dispersing auxiliaries, the procedure of Example Ia is followed and the following are homogenized:

- 6.7 parts by weight of carbon black,
- 51.6 parts by weight of styrene/n-butyl methacrylate (70:30) copolymer, Paraloid® B-66 of Rohm & Haas Co., USA,
- 40.4 parts by weight of aliphatic hydrocarbon resin, Escorez® 1102 B of Esso-Chemie GmbH., and
- 1.3 parts by weight of polyvinyl stearate, PVS-15 of Allaco Products, USA.

EXAMPLE If

To manufacture a pigmented polymer which at the same time contains a soluble polymer acting as the protective colloid, the dispersing auxiliary and the control agent, the procedure of Example Ia is followed and the following are homogenized at a temperature of approximately 150° C.:

- 3.6 parts by weight of carbon black,
- 48.9 parts by weight of vinyltoluene/octyl acrylate copolymer,
- 32.5 parts by weight of styrene/butadiene copolymer,
- 14.2 parts by weight of colophony ester Pentalyn® H of Hercules Powder Company, and 0.8 part by weight of Spirit-soluble Nigrosin.

EXAMPLE Ig

The following are homogenized in the manner of Example If, at a temperature of 145° C.:

1.8 parts by weight of carbon black,
55.4 parts by weight of vinyltoluene/octyl acrylate copolymer,
37.0 parts by weight of styrene/butadiene copolymer,
4.6 parts by weight of polyvinyl stearate, and
1.2 parts by weight of Reflex Blue B (C.I. 42,765).

EXAMPLE Ih

To manufacture a more highly pigmented polymer which at the same time contains a soluble polymer acting as the protective colloid, the procedure in Example Ia is followed and the following are homogenized at a temperature of approximately 140° C.:

20.0 parts by weight of carbon black,
47.8 parts by weight of vinyltoluene/octyl acrylate copolymer, and
32.2 parts by weight of styrene/butadiene copolymer.

EXAMPLE Ii

To manufacture a more highly pigmented polymer which at the same time contains a protective colloid and a control agent, the procedure in Example Ia is followed and the following are homogenized at a temperature of approximately 155° C.:

17.8 parts by weight of carbon black,
42.1 parts by weight of vinyltoluene/octyl acrylate copolymer,
28.8 parts by weight of styrene/butadiene copolymer, and
11.3 parts by weight of Reflex Blue B.

II The procedure when manufacturing a liquid developer according to the invention from the pigmented polymers described above is illustrated by the examples which follow.

Comparative Example IIa

The experiment to manufacture a developer at room temperature is carried out as follows: 5.8 parts by weight of styrene/butadiene copolymer are dissolved in 40.0 parts by weight of Isopar ® H. 9.0 parts by weight of pigment polymer from Example Ia and 0.14 part by weight of Reflex Blue AMF, which has first been worked into a paste with 2.4 parts by weight of Isopar H, are added to the preceding solution in a disperser at 20° C. The mixture is now ground for 30 minutes in a ball mill at 20° C. 42.4 parts by weight of Isopar G are then added slowly while continuing grinding. After the entire amount of Isopar G has been added, it is found that instead of a dispersion a viscous gummy mass has formed.

Comparative Example IIb

The same components of Comparative Example IIa, in the same ratios, are used. However, the vinyltoluene/octyl acrylate copolymer is not pigmented with carbon black before it is used.

8.7 parts by weight of vinyltoluene/octyl acrylate copolymer are dispersed together with 20.15 parts by weight of Isopar H for 5 minutes in a disperser at 80° C. 0.3 part by weight of carbon black is then added to this mixture and dispersing is continued for an additional 5 minutes. A solution of 5.8 parts by weight of styrene/butadiene copolymer in 20.15 parts by weight of Isopar H is then added, the mixture is dispersed for an additional 10 minutes and 0.14 part by weight of Reflex Blue AMF, worked into a paste in 2.4 parts by weight of Isopar H, is then added. The mixture is ground for 30 minutes at 80° C. in a ball mill and then cooled to room temperature, and 42.4 parts by weight of Isopar G are slowly added while continuing grinding. After grinding for 30 minutes, a liquid developer concentrate is obtained, of which the particles have a diameter of 60–90 μm, in contrast to the toner according to the invention. The concentrate is diluted as in Comparative Example IIa.

In contrast to the copies obtained using toner according to the invention, only very weak copies are obtained. The bulk of the toner image remains on the photoconductor and is not transferred onto the paper. In addition, the dispersion stability of the toner is very much lower.

Comparative Example IIc

The procedure in Comparative Example IIb is followed but instead of carbon black, a dispersed type of carbon black is used, for example 1.6 parts by weight of Microlith Black 21,816 T of Ciba-Geigy AG. In contrast to the developer according to the invention, obtained according to Example 1, the liquid developer obtained from this concentrate gives only blurred copies with numerous specks. The bulk of the toner image remains on the photoconductor and is not transferred to the paper.

III Manufacture of a liquid developer from a pigmented polymer:

EXAMPLE 1

5.8 parts by weight of styrene/butadiene copolymer, for example Solprene ® 1205 of Phillips Petroleum Company, USA, are dissolved in 40.3 parts by weight of an aliphatic hydrocarbon of boiling range 174°–191° C., for example Isopar H. 9.0 parts by weight of pigmented polymer from Example Ia and 0.14 part by weight of Reflex Blue AMF, which have first been worked into a paste with 2.4 parts by weight of Isopar H, are added to the above solution in a disperser at 80° C. The entire mixture is ground for 30 minutes in a ball mill at 80° C. It is then cooled to room temperature and 42.4 parts by weight of Isopar G are added slowly while continuing grinding. After grinding for 30 minutes, a liquid developer concentrate the particles of which have an average diameter of 5 μm and of which the largest particles are less than 11 μm is obtained.

If 6–8 parts by volume of Isopar G are added to 1 part by volume of this concentrate, a ready-to-use, electrophotographic liquid developer is obtained. This liquid developer develops negative charge images, such as can be obtained, for example, by charging and image-wise exposure of a polyvinylcarbazole-trinitrofluorenone photoconductor layer (molar ratio 1:1). Contrast-rich images of good sharpness are obtained which, after removal of excess developer, can be transferred practically completely onto smooth paper by simple bringing into contact.

If desired, the tackiness of the pigmented polymer deposited on the photoconductor can be increased by adding an aromatic hydrocarbon as the solvent, for example Solvesso ® 100 (Esso), having a boiling range of 160°–180° C.

The amount added can be, for example, 2 g per 1 liter of liquid developer. However, ketones, such as, for example, methyl ethyl ketone, or esters, such as, for example, butyl acetate, or halogenated hydrocarbons also swell the sparingly soluble polymer and thereby increase the tackiness even on addition of only small amounts.

EXAMPLE 2

The procedure in Example 1 is followed but instead of Reflex Blue AMF the same amount of a paste containing 33 percent by weight of dyestuff is employed, which is produced by reaction of oleic acid with Nigrosin Base C or Induline Base N or Induline Base NR, and is subsequently ground on a 3-roll mill.

In all 3 cases, liquid developers the particles of which have an average diameter of less than 5 μm are obtained. The copies obtained with these developers are distinguished by great sharpness, very good resolution and a clean background.

EXAMPLE 3

The manufacture of a liquid developer from a pigmented polymer which at the same time contains a control agent is carried out as in Example 1, from 6.3 parts by weight of styrene/butadiene copolymer, Solprene® 1204, of Phillips Petroleum Company, USA, 42.1 parts by weight of Isopar H, 9.9 parts by weight of a pigmented polymer prepared according to Example Ib and 41.7 parts by weight of Isopar G. Particles of an average diameter of 4 μm result, the finest constituents being less than 1 μm. Instead of the polymer prepared according to Example Ib, a polymer prepared according to Example Ic may be employed with good results.

EXAMPLE 4

The manufacture of a liquid developer from a pigmented polymer which at the same time contains the soluble polymer acting as the protective colloid, and a control agent, is carried out analogously to Example 1 from 16.1 parts by weight of a pigmented polymer prepared according to Example Id, 42.1 parts by weight of Isopar H and 41.8 parts by weight of Isopar G. The resulting developer has very fine particles. The average particle diameter is less than 3 μm.

EXAMPLE 5

To manufacture a liquid developer from a pigmented polymer which at the same time contains dispersing auxiliaries, the following procedure is followed: 5.5 parts by weight of vinyltoluene/octyl acrylate copolymer, for example Pliolite® VTAC of Goodyear Tire and Rubber Co., USA, are dispersed with 19.5 parts by weight of Isopar H for 5 minutes at 80° C. in a disperser. 9.3 parts by weight of a pigmented polymer prepared according to Example Ie are then added and the mixture is dispersed for an additional 5 minutes. A solution of 5.7 parts by weight of styrene/butadiene copolymer, Solprene® 1205, in 19.5 parts by weight of Isopar H, is then added, the mixture is dispersed for an additional 10 minutes and 0.14 part by weight of Reflex Blue AMF, worked into a paste in 2.3 parts by weight of Isopar H, is then added. The mixture is ground for 30 minutes at a temperature of 80° C. in a ball mill and is then cooled to room temperature, and 41.0 parts by weight of Isopar G are added slowly while continuing grinding. After grinding for 30 minutes, a liquid developer with toner particles of an average particle diameter 12 μm is obtained.

EXAMPLE 6

The manufacture of a liquid developer from a pigmented polymer which at the same time contains the soluble polymer acting as the protective colloid, a dispersing auxiliary and a control agent, is carried out analogously to Example 1 from 17.9 parts by weight of a pigmented polymer prepared according to Example If, and 41.3 parts by weight of Isopar G. The average particle diameter is 4.5 μm.

EXAMPLE 7

A liquid developer is manufactured analogously to Example 4 from 16.0 parts by weight of a pigmented polymer prepared according to Example Id, 41.9 parts by weight of Isopar H and 41.6 parts by weight of Isopar G, to which 0.5 part by weight of a fatty alcohol polyglycol ether, Genapol S-020 of Fw. Hoechst AG, has been added. A liquid developer with fine particles, the average particle diameter being 4 μm, is obtained.

The same action as dispersing auxiliaries is also shown by fatty alcohol polyglycol ethers, such as, for example, Emulsogen® M, fatty acid polyglycol esters, for example Emulsogen SG of Farbwerke Hoechst, or polyvinyl stearate.

EXAMPLE 8

This example describes the use of a more highly pigmented polymer which at the same time contains a protective colloid and a control agent.

8.6 parts by weight of vinyltoluene/octyl acrylate copolymer are dispersed with 21.0 parts by weight of Isopar H for 5 minutes at 80° C. in a disperser. 1.8 parts by weight of a pigmented polymer prepared according to Example Ii are then added and the mixture is dispersed for an additional 5 minutes. A solution of 5.8 parts by weight of styrene/butadiene copolymer in 21.0 parts by weight of Isopar H is then added. Dispersing is continued for 10 minutes and the mixture is then ground for 30 minutes at a temperature of 80° C. in a ball mill. It is then cooled to room temperature and 41.8 parts by weight of Isopar G are added slowly while continuing grinding. After an additional 30 minutes' grinding, a liquid developer with toner particles having an average diameter of 7.5 μm is produced.

It will be obvious to those skilled in the art that many modifications may be made within the scope of the present invention without departing from the spirit thereof, and the invention includes all such modifications.

What is claimed is:

1. In the process for the preparation of a liquid developer for use in a toner image transfer process for developing electrostatic images which comprises preparing a homogeneous paticulate mixture of at least one pigment and at least one copolymer of vinyl toluene or styrene with an ester of acrylic or methacrylic acid, the improvement which comprises dispersing and grinding the mixture in an electrically insulating carrier liquid composed of an aliphatic hydrocarbon or a mixture of aliphatic hydrocarbons having a boiling point or boiling range in the range of 120° to 200° C. in the absence of an additional solvent for the polymer, at a temperature in the range of about 50°-150° C. at which temperature the polymer of the mixture is appreciably soft, and continuing grinding the resulting mixture as it cools to room temperature.

2. A process as claimed in claim 1 wherein the mixture of polymer and pigment includes a dyestuff.

3. A process as claimed in claim 2 wherein the mixture of polymer and pigment includes a dyestuff selected from Reflex Blue B (C.I. 42,765), Spirit-soluble Nigrosin (C.I. 50,420), Fat Black HB (C.I. 26,150) and Fat Black HBN (C.I. 26,150).

4. A process as claimed in claim 1 wherein the mixture of polymer and pigment includes a protective colloid.

5. A process as claimed in claim 1 wherein a protective colloid is added to the carrier liquid prior to the addition of the solid mixture.

6. A process as claimed in claim 5 wherein the protective colloid is selected from copolymers of butadiene and styrene, polyvinyl stearates, esters of colophony and aliphatic hydrocarbon resins.

7. A process as claimed in claim 1 wherein a dispersing auxiliary selected from fatty alcohol polyglycol esters and fatty alcohol polyglycol ethers is added.

8. A process as claimed in claim 1 wherein a control auxiliary comprising a salt of a dyestuff base and a fatty acid having 16 to 18 carbon atoms is added.

9. A process according to claim 1 in which the copolymer of vinyl toluene or styrene with an ester of acrylic or methacrylic acid is a copolymer of vinyl toluene and octyl acrylate, or a copolymer of styrene and n-butyl methacrylate.

10. A process according to claim 1 including adding additional carrier liquid to said mixture as it cools to room temperature.

* * * * *